US006807822B1

(12) United States Patent
Martinson

(10) Patent No.: US 6,807,822 B1
(45) Date of Patent: Oct. 26, 2004

(54) JEWELRY LEARNING SYSTEM AND METHOD

(76) Inventor: Valarie Jean Martinson, 4622 Houndshaven Way, San Jose, CA (US) 95111

( * ) Notice: Subject to any disclaimer, the term of this patent is extended or adjusted under 35 U.S.C. 154(b) by 10 days.

(21) Appl. No.: 10/353,740

(22) Filed: Jan. 28, 2003

(51) Int. Cl.[7] ..... A44C 13/00
(52) U.S. Cl. ..... 63/1.13; 63/1.11; 63/40
(58) Field of Search ..... 63/1.11–1.13, 1.16–1.18, 63/1.14, 3, 4, 15–15.9, 33, 38, 40, 18, 21, 23

(56) References Cited

U.S. PATENT DOCUMENTS 1,087,015 A * 2/1914 Heylum ..... 63/1.13
1,539,781 A * 5/1925 Smythe ..... 63/1.14
2,827,309 A * 3/1958 Fred ..... 63/1.14
4,179,833 A * 12/1979 Knodel ..... 63/1.13
4,534,185 A * 8/1985 Berry et al. ..... 63/14.3
4,879,882 A * 11/1989 Johnson et al. ..... 63/4
5,291,755 A * 3/1994 Grant ..... 63/23

OTHER PUBLICATIONS

US patent application Publication 2003/0182963, Beatty, Oct. 2003.*

* cited by examiner

*Primary Examiner*—Robert J. Sandy
*Assistant Examiner*—Ruth C. Rodriguez
(74) *Attorney, Agent, or Firm*—Risto A. Rinne, Jr.

(57) ABSTRACT

An apparatus and method of using jewelry to mark the attainment of personal goals includes a first and a second article of jewelry. An object that has a message inscribed thereon, preferably in shorthand, is detachably attached to the first article of jewelry until the attainment has occurred. Subsequent to the attainment, the object is removed from the first article of jewelry and is transferred to the second article of jewelry where it remains indefinitely. The second article of jewelry is adapted to retain a plurality of objects.

17 Claims, 1 Drawing Sheet

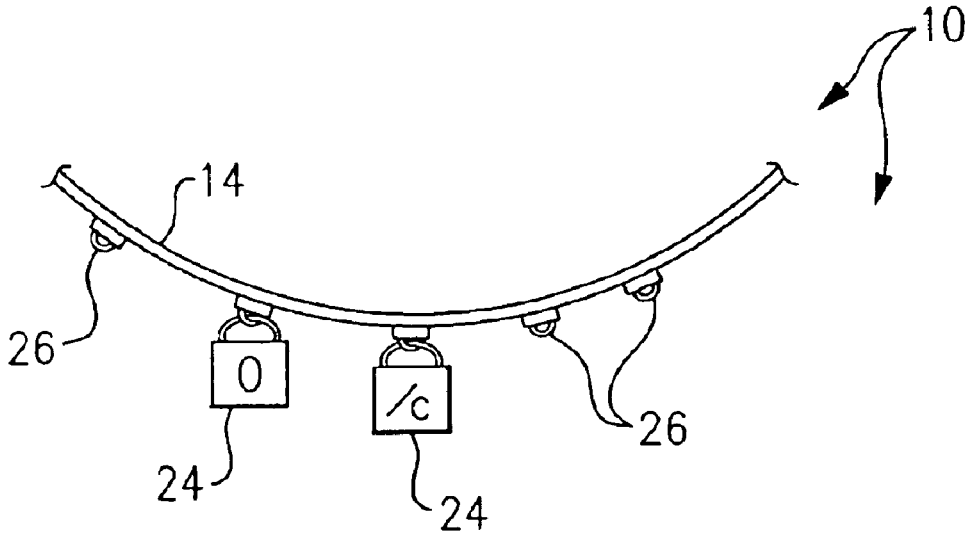
10
14
26
O
/c
26
24
24
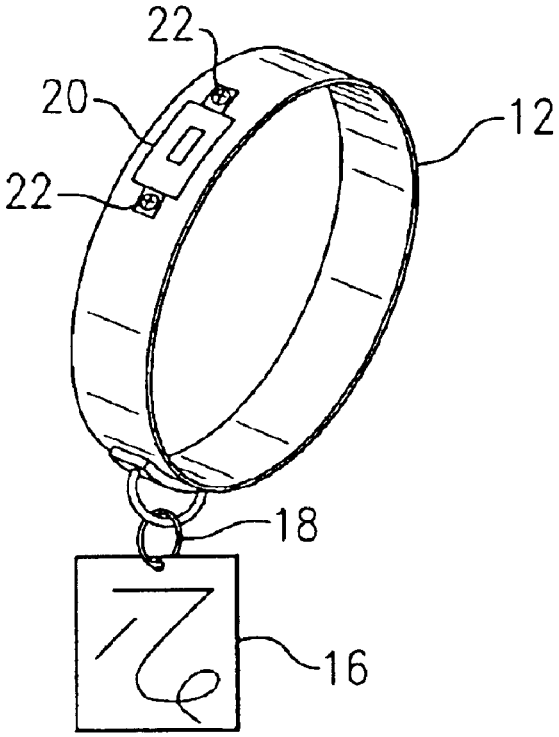
22
20
12
22
18
16

JEWELRY LEARNING SYSTEM AND METHOD

BACKGROUND OF THE INVENTION

1. Field of the Invention

The present invention, in general relates to both jewelry and reminders and, more particularly, to a jewelry system that provides a reminder and that, once its message is assimilated, the reminder is displayed in a new way.

Jewelry has typically been worn to flatter, attract attention, or to better express one's interests, hobbies, and passions. For example, if someone is into tennis, they may wear earrings that each include a dangling tennis racket. Clearly, the motive of wearing jewelry to flatter is obvious as is the desire to attract attention. This is well attested to by the size of the diamond or the glistening amount of gold that is employed in the jewelry item.

However, for many people there is a deep and developing desire to learn, to grow, and to heal from past traumas. For those who desire any of these things, the inertia of past habits can be difficult to overcome. If a person wants to learn "acceptance of what is", for example, yet finds himself or herself often reacting strongly to disturbing news, then such a person may want to have a reminder close at hand that, if spotted, can remind them not to fight against current circumstances, but instead to passively allow events to reveal the facts of the matter, in other words to accept what is.

Any such learning or amending of past habits is, in reality, part of a process, one that is not accomplished overnight. Mastery is not obtained by a mere declaration of intent. It takes time to change, yet change does occur and eventually there comes a time when the person has attained a certain level of mastery, regardless of the subject. The person must then rely not on the opinions of others but on a deep inner knowing that they have in fact attained a new level of awareness or a new way of responding to the world and that this change has now become a part of who they actually are. In short, their nature will have changed to some degree.

The realization that this has happened usually comes as a jolt. A person goes through an event, a crisis; a situation and then some time later they are startled to discover that they responded to that crisis in an entirely new way. After a few more incidents or tests, there comes a time when they realize that they have, in fact, materially changed their nature.

Unfortunately, there is no effective way to celebrate nor is there any accepted ritual to acknowledge this type of an attainment. No diploma is awarded for this type of growth and inner development. There is no outward public display or indication of such attainment and there is no acknowledgment that the "student of life" can see as a reminder of their own diligence and attainment, either. It is elementary human nature to receive acknowledgment for a substantial accomplishment, yet when the accomplishment appertains to personal growth, there is no acknowledgment given for the effort.

It does not matter what other people may think, that is if other people were to rate the level of attainment. Personal growth is an inner, personal matter whereby the person who embarks on a growth path remains ultimately the sole determinant of his or her progress.

Furthermore with regards to jewelry, it must be attractive or at the very least interesting. If a jewelry item is interesting, that is if it attracts attention and comment, it by its very novelty, effectively serves to promote its own acceptance and widening usage.

Also, the amount of area on jewelry is limited. Therefore, any message or reminder must make avail of a limited amount of space. English is generally not regarded as being sufficiently space-efficient for this purpose.

Additionally, it is desirable to find like-minded people to provide emotional support and encouragement as a person works on inner self-transformation. Ideally, a jewelry learning system and method would provide an indication that was discernible primarily to those who are either working on similar personal goals or who are at least aware of them. Accordingly, the wearer of such a article of jewelry would not be burdened by the derogatory comments of skeptics but would instead attract the support of like-minded people. In other words, if the message or reminder is encoded, this provides an additional level of buffering for the wearer.

Accordingly, there exists today a need for a jewelry learning system and method that promotes personal growth and which provides an acknowledgment thereof.

Clearly, a jewelry learning system and method is useful and desirable.

2. Description of Prior Art

Jewelry is, in general, well known. While the structural arrangements of the previously known devices, at first appearance, may have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a jewelry learning system and method that promotes self-awareness.

It is also an important object of the invention to provide a jewelry learning system and method that promotes learning.

Another object of the invention is to provide a jewelry learning system and method that provides a reminder.

Still another object of the invention is to provide a jewelry learning system and method that includes a written message that can serve as a reminder.

Still yet another object of the invention is to provide a jewelry learning system and method that includes a written message that is presented in a manner that is perceived as novel and attractive.

Yet another important object of the invention is to provide a jewelry learning system and method that includes a written message that is presented in a manner that appears as if it were written in a foreign language.

Still yet another related object of the invention is to provide a jewelry learning system and method that includes a message that is presented using a minimum amount of area.

Still yet another important object of the invention is to provide a jewelry learning system and method that includes a written message that is presented in shorthand.

It is a first continuing object of the invention is to provide a jewelry learning system and method that includes a first and a second jewelry item wherein an object is attached initially to the first jewelry item and, subsequent to a personal assessment of a milestone of progress, is transferred to the second jewelry item.

It is a second continuing object of the invention is to provide a jewelry learning system and method that provides a public display of a self-perceived level of attainment.

It is a third continuing object of the invention is to provide a jewelry learning system and method that provides a personally visible display of a self-perceived level of attainment.

It is a fourth continuing object of the invention is to provide a jewelry learning system and method that provides a pleasant reminder of a goal that has been attained.

It is a fifth continuing object of the invention is to provide a jewelry learning system and method that can be used to show a plurality of attainments.

It is a sixth continuing object of the invention is to provide a jewelry learning system and method that provides an indication of a current personal goal.

It is a seventh continuing object of the invention is to provide a jewelry learning system and method that provides a confidential indication of a current goal.

It is an eight continuing object of the invention to provide a jewelry learning system and method that encodes a message in shorthand and thereby uses a minimal amount of space.

It is a ninth continuing object of the invention is to provide a jewelry learning system and method that provides a public display of a current goal.

Briefly, a jewelry learning system and method that is constructed in accordance with the principles of the present invention has a first jewelry item worn at a first location on a body of a user and a second jewelry item that is worn at a second location on the body. An object is attached initially to the first jewelry item and, subsequent to a personal assessment that a milestone of progress has been reached, the object is then transferred to the second jewelry item. The object includes a message that serves either as a reminder or as an inspirational message to the user. According to a preferred embodiment, the message is encoded in shorthand, thereby taking up minimal space and providing a unique ornamental presentation that is both attractive and mysterious.

BRIEF DESCRIPTION OF THE DRAWING

The drawing FIGURE is a view in perspective of a jewelry learning system and method.

DETAILED DESCRIPTION OF THE INVENTION

Referring to the drawing FIGURE is shown, a jewelry learning system and method, identified in general by the reference numeral 10.

A first jewelry item 12 is worn at a first location on a body of a user (not shown) and a second jewelry item 14 is worn at a second location on the body.

An object 16 is attached initially to the first jewelry item 12 and, subsequent to a personal assessment that a milestone of progress has been reached, the object 16 is then transferred to the second jewelry item 14.

The object 16 includes a message that serves either as a reminder or as an inspirational message to the user. Since space is limited, the message is preferably encoded in shorthand, a medium of communication that is well known and widely used in corporate America.

The message on the object 16 is in shorthand and it says to "Embrace it". This is another way of providing an inspirational message and friendly reminder to accept the present moment as it is, to not fight what is, and instead to accept whatever is happening this moment.

A preferred type of jewelry for the first jewelry item 12 includes a ring, because the ring is well adapted to display one at a time, the object 16.

Whatever the object 16 displayed on the first jewelry item 12 is representative of the current goal that the user is working on. Preferably, only the one object 16 is attached (at a time) on the first jewelry item 12.

Accordingly, others who become aware of the jewelry learning system and method 10 will be inclined to favorably respond to any user that is spotted who is also engaged in the process of self-improvement. Accordingly, the jewelry learning system and method 10 can not only provide a personal reminder of a particular goal or inspirational message, but it also provides the unexpected benefit of attracting support and encouragement from others.

The object 16 can be any shape, formed out of any desired material, or any size. It can contain any message and the message can be written in any language, although shorthand is preferred.

The object 16 is attached to the first jewelry item 12 in any preferred way that later allows for its subsequent removal and re-attachment at a new location elsewhere, as is described in greater detail hereinafter. A jewelry clasp 18, common on necklaces, is shown as one possible type of attachment.

If desired, a smaller version of the object 20 can be embedded into the first jewelry item 12. A pair of screws 22 secure the smaller version of the object 20 in place and allow for its later removal.

The object 16 is worn on the first jewelry item 12 for as long as the user decides. Once the user determines by way of personal assessment that a milestone of progress has been reached, the object 16 is removed from its position of prominence on the first jewelry item 12 and is then transferred to a location on the second jewelry item 14 where it is attached and allowed to remain indefinitely.

The second jewelry item 14 displays all transferred objects 24 that were once displayed for a time on the first jewelry item 12. As many attachment points 26, as desired, are provided on the second jewelry item 14 for the attachment of as many of the transferred objects 24, as is desired.

The second jewelry item 14 is only partly shown and includes any type of a necklace, bracelet, anklet, earring, or any other type of a jewelry item. The second jewelry item 14 also provides personal reminders of past goals that have been attained.

The second jewelry item 14 also encourages the wearer to persist in reaching even higher levels of attainment of past goals by keeping them in view and therefore in mind.

The user can also reflect from time to time on these past accomplishments by looking at all the past objects that have been transferred to the second jewelry item 14.

And certainly, much like a Medal of Valor, the second jewelry item 14 provides a public display of one's accomplishments that a person who is familiar with the jewelry learning system and method 10 will recognize, value, and appreciate.

If desired, any conceivable type of a jewelry item can serve as the first jewelry item 12 and any other conceivable type of a jewelry item can serve as the second jewelry item 14. The examples provided in this specification are intended only to be illustrative and not limiting.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A jewelry system, comprising:

(a) a first article of jewelry adapted to be worn at a first location on a body; and (b) a second article of jewelry adapted to be worn at a second location on said body wherein said second location is different than said first location;

(c) wherein said first article of jewelry includes means adapted for detachably-attaching an object thereto;

(d) wherein said second article of jewelry includes means adapted for detachably-attaching said object thereto; and wherein said object includes a message and wherein said object is attached to said first article of jewelry for a period of time and is then transferred to said second article of jewelry upon the occurrence of an event.

2. The jewelry system of claim 1 wherein said message is encoded.

3. The jewelry system of claim 1 wherein said message is in shorthand.

4. The jewelry system of claim 1 wherein said occurrence of an event includes an attainment.

5. The jewelry system of claim 4 wherein said attainment includes the attainment of a personal goal.

6. The jewelry system of claim 1 wherein said second article of jewelry is adapted to receive a plurality of objects.

7. The jewelry system of claim 6 wherein each of said plurality of objects includes a different message.

8. The jewelry system of claim 1 wherein said message includes an affirmation.

9. The jewelry system of claim 1 wherein said message includes a personal goal.

10. The jewelry system of claim 1 wherein said first article of jewelry includes a ring.

11. The jewelry system of claim 10 wherein said ring includes means adapted for receiving said object.

12. The jewelry system of claim 11 wherein said means adapted for receiving said object includes a loop that is attached to said ring.

13. The jewelry system of claim 1 wherein said second article of jewelry is selected from the group consisting of a necklace, bracelet, anklet and earring.

14. A jewelry learning method, consisting of the steps of:

(a) providing a first article of jewelry that is adapted to be worn at a first location on a body; and (b) providing a second article of jewelry that is adapted to be worn at a second location on said body wherein said second location is different than said first location;

(c) and including an object that has a message thereon;

(d) wherein said first article of jewelry includes means adapted for detachably-attaching said object thereto;

(e) wherein said second article of jewelry includes means adapted for detachably-attaching said object thereto; and (f) transferring said object from said first article of jewelry to the second article of jewelry upon occurrence of a trigger event.

15. The method of claim 14 including the step of attaching said object to said first article of jewelry for a period of time until an occurrence of said trigger event and subsequent to said occurrence of said trigger event, including the further step of removing said object from said first article of jewelry and attaching said object to said second article of jewelry.

16. The method of claim 15 wherein said occurrence of said trigger event includes the step of having a user determine that a personal level of attainment has occurred.

17. The method of claim 15 wherein said occurrence of said trigger event includes the step of having a user determine that a personal goal has been achieved.

* * * * *